United States Patent [19]

Goss

[11] Patent Number: 4,886,447

[45] Date of Patent: Dec. 12, 1989

[54] BURNER ASSEMBLY

[75] Inventor: Charles T. Goss, Glenshaw, Pa.

[73] Assignee: Goss, Inc., Glenshaw, Pa.

[21] Appl. No.: 194,310

[22] Filed: May 16, 1988

[51] Int. Cl.[4] ..... F23D 14/02

[52] U.S. Cl. ..... 431/353; 239/590.3; 239/432

[58] Field of Search ..... 431/344, 353; 239/432, 239/590.3, 590.5

[56] References Cited

U.S. PATENT DOCUMENTS

| | | | |
|---|---|---|---|
| 1,494,009 | 5/1924 | Napolitan | 239/432 |
| 2,888,980 | 6/1959 | Williams et al. | 239/590.3 X |
| 3,536,429 | 10/1970 | Lake | 431/353 |
| 3,663,154 | 5/1972 | Locke | 431/353 |
| 3,685,740 | 8/1972 | Shepherd | 431/353 X |
| 3,736,093 | 5/1973 | Bowman et al. | 431/353 X |
| 3,905,755 | 9/1975 | Aske | 431/344 |
| 4,013,395 | 3/1977 | Wormser | 431/353 X |
| 4,255,124 | 3/1981 | Baranowski | 431/353 |
| 4,639,215 | 1/1987 | Armstrong | 431/353 X |
| 4,732,559 | 3/1988 | Pearl et al. | 431/353 X |

FOREIGN PATENT DOCUMENTS

| | | | |
|---|---|---|---|
| 133880 | 8/1949 | Australia | 239/590.3 |
| 219203 | 7/1908 | Fed. Rep. of Germany | 239/432 |

*Primary Examiner*—Randall L. Green

*Attorney, Agent, or Firm*—Clifford A. Poff

[57] ABSTRACT

A gas burner assembly for producing a high intensity flame while also producing a flame of a large area. The burner assembly includes a hollow shell having a stem member engaged at one end thereof for supplying a combustible gaseous mixture to the shell. A circular, disk-shaped slug member which contains a plurality of cavities extending therethrough directs the flow of the gaseous mixture through the cavities. The longitudinal axes of the plurality of cavities extending through the slug member extend an angles relative to the the longitudinal axis of the shell. Part of the combustible gaseous mixture is caused to emerge from each cavity and strike and be reflected from the interior walls of the shell, causing the velocity of the gas to decrease. The reflected gaseous mixture is recombined at a lower velocity with gas stream parts which do not impinge on the shell.

16 Claims, 1 Drawing Sheet

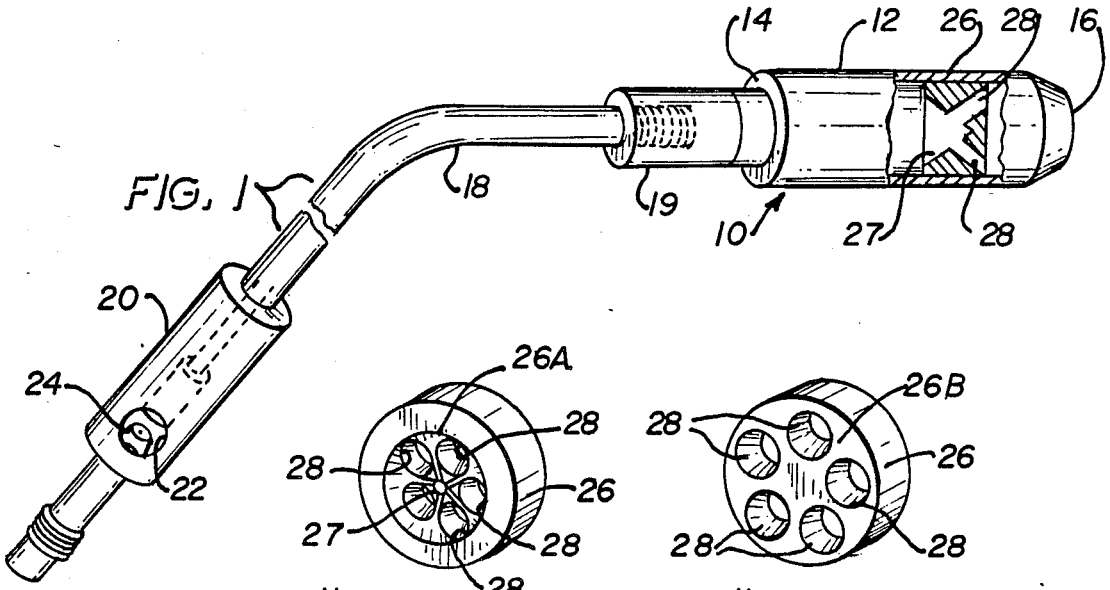
FIG. 1
FIG. 2
FIG. 3
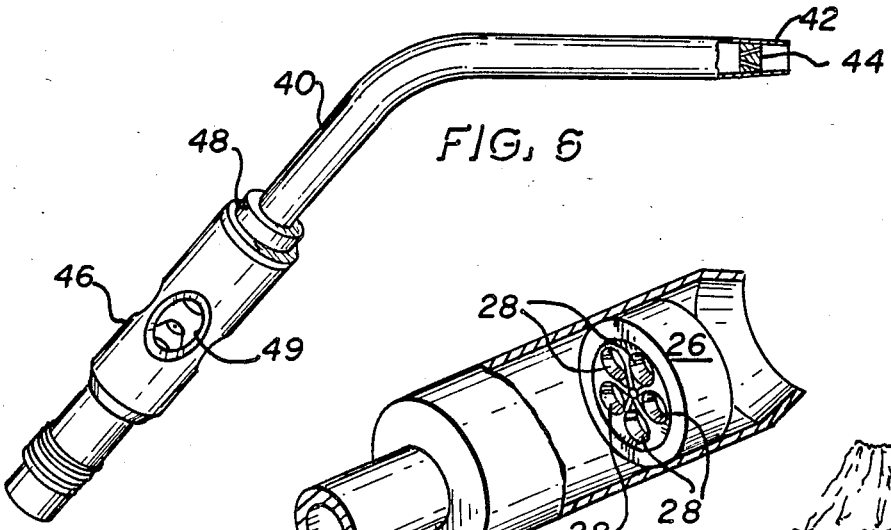
FIG. 6
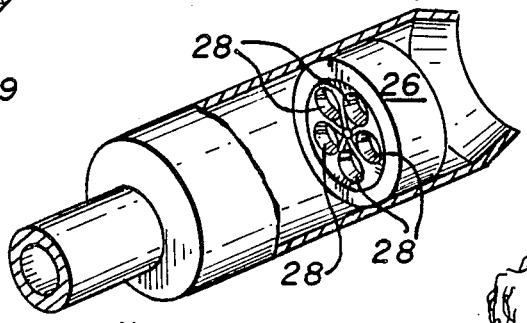
FIG. 4
FIG. 3A
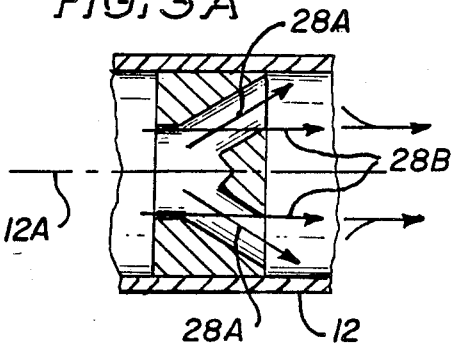
FIG. 5
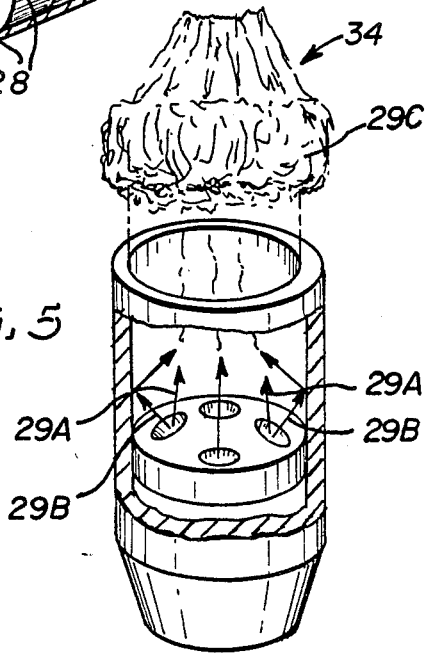

BURNER ASSEMBLY

BACKGROUND OF THE INVENTION

1. Field of The Invention

The present invention relates generally to gas burners, and more particularly, to an improved burner assembly construction for a blow torch type burner.

2. Descriptions Of The Prior Art

The application and use of gas burners in many varying fields is well known. Gas burners are required, for example, for use in applications involving boilers, internal combustion engines, and many other devices, as well as for use in applications requiring soldering and brazing of metals. In every application, however, attempts have been made to most advantageously burn a combustible gas for the particular application.

Many such attempts involve the manipulation of the flow of the combustible gas to cause ignition of the gas in a desired location or manner. For example in a radiant cell gas burner disclosed in U.S. Pat. No. 2, 070,859, a combustible gas is caused to be propelled in a spiralling pattern through the burner cell so as to repeatedly strike the ceramic side walls of the cell. Such repeated striking of the gas against the walls causes an increased proportion of the heat generated during combustion of the gas to be transformed into radiant heat.

Of particular importance to the present invention is the generation of a flame by a burner utilized for soldering and brazing metals. Frequently referred to as blow torch burners, many such burners have been developed to burn various gasses.

Different types and mixtures of combustible fuels are utilized by such burners for each specific application. For example, propane and butane are common fuel sources for low temperature welding or brazing applications, and other fuels, such as acetylene, are utilized when higher temperature flames are required in other welding applications.

One such prior art burner is disclosed in U.S. Pat. No. 4,013,395. The burner disclosed therein causes a combustible gas to evolve through a burning chamber in a spiralling fashion to create a flame at an exit end thereof suitable for brazing of metals. The flame produced by this burner, however, is short, but undersirable because of its loud noise and uneven flame, the excessive loud noise and uneven flame is caused by the helical rotation of the gases plus three large passage ways (vanes).

Use of this or other prior art burners is therefore at times disadvantageous. Far more preferable would be a use of a burner which produces a compact, quieter flame, having an even large heat zone. In the prior art, however, no such burners are known to exist.

What is needed, therefore, is a gas burner assembly apparatus which allows a combustible fuel mixture to produce a broad flame so as to allow more controllable even heating of a braze area of a metal.

This invention deals primarily with a burner that uses atmospheric air for combustion instead of oxygen. The use of atmospheric air is less expensive than oxygen, but yields suitable temperatures for heating, soldering and brazing. Oxygen, however, is necessary for cutting because of rapid oxidation needed to cut metal with acetylene, propane, butane, etc.

In prior art of atmospheric air torches it is known to mix the air with the gas in various ways but all fail to produce an optimum flame. Some burners businesses or torch tips do not have a mixing device in the flame tube to enhance mixing. Those that do have a mixing device use slugs having straight holes, straight vanes, helical holes or helical vanes in the slugs to mix the air-gas. The burner device of the present invention uses a mixing slug that has straight holes arranged to diverge outwardly toward the bluff-end in relation to the flow of gas-air. This design and relation of parts improves mixing of the gas and the atmospheric air. The flame tube walls are kept cool because of the divergent angles and the velocity of the mixture is fast, but not so fast as to lose the proper mixture.

It is therefore an object of the present invention to overcome the disadvantages associated with the prior art.

It is a further object of the present invention to provide a burner assembly which provides a flame having a uniform even heat zone to allow even heating of a braze or weld joint area of a metal that it not greatly effected by regulator changes in gas pressure, therefore it is easier to operate by the user.

It is a yet further object of the present invention to provide a burner assembly which provides a compact but quieter flame having a large heat zone when burning any of a variety of combustible gaseous mixtures.

SUMMARY OF THE PRESENT INVENTION

In accordance with the present invention, a gas burner assembly for producing an even, quieter flame of a broad flame area is disclosed. The burner assembly includes an elongated, hollow housing having walls. A gas supply means is attached to the housing for supplying to the housing a combustible gaseous mixture, and a directing means is positioned within the housing for directing the flow of the gaseous mixture through the housing such that part of the gaseous mixture is caused to strike and be reflected from the walls of the housing at which point the mixture may be ignited.

The gas supply means may, for example, comprise a stem member suitable for the flow of the gaseous mixture therethrough attached at one end to the housing; the stem member may be connected at a second end thereof to a back piece having at least one orifice opening thereinto for supplying a combustible gaseous mixture thereto, and at least one orifice opening there into for supplying air thereto. The back piece allows the combustible gas to be mixed with air in a desired ratio. In the preferred embodiment, the combustible gaseous mixture is supplied to the housing by the stem member at a velocity great enough to allow combustion of the mixture only after part of the mixture is reflected from the walls of the housing.

The directing means may, for example, be comprised of a slug member positioned in the housing so as to span a cross-section of the housing, with the slug member containing a plurality of cavities extending therethrough to thereby direct part of the combustible gaseous mixture at incident angles causing the gaseous mixture to be reflected from the walls and join with another part of the gas mixture passing through the slug cavities without deflection.

In one embodiment of the present invention, the slug member contains a central bore extending into one face of the slug member whereat the plurality of cavities extend therefrom to the second face of the slug member. The longitudinal axes of the respective cavities extend at angles relative to the longitudinal axis of the housing so as to cause the combustible gaseous mixture emerge as stream parts some moving generally parallel to the longitudinal axis of the housing and other stream parts when directed therethrough to diverge from the longitudinal axis and thereby strike at incident angles to be reflected. The housing may, for example, be cylindrical in configuration, and may further include at a discharge end thereof, a swaged end portion.

BRIEF DESCRIPTION OF THE DRAWINGS

The features and advantages of the present invention will be more fully understood when the description is read in light of the accompanying drawings in which:

FIG. 1 is a perspective view, partially in section, of the burner assembly of the present invention;

FIG. 2 is a side view, in elevation, of one face of the slug member of the burner assembly of the present invention in which the central bore hole extending into the slug member is illustrated;

FIG. 3 is a side view, in elevation of the second face of the slug member of the present invention in which the plurality of cavities extending through the slug member for directing the combustible gaseous mixture.

FIG. 3A is a cross-sectional view of the slug member along line III—III of FIGS. 2 or 3;

FIG. 4 is a perspective, cut-away view of the burner assembly of the present invention in which the position of the circular slug member within the shell structure is illustrated;

FIG. 5 is a perspective, cut-away view, of the shell structure and slug member of the burner assembly of the present invention in which the direction of travel of the combustible gaseous mixture and the broad, evenly heated flame produced thereby are illustrated; and FIG. 6 is a perspective view partially in section of the preferred embodiment of the burner according to the present invention.

DESCRIPTION OF THE PREFERRED EMBODIMENT

Referring now to FIG. 1, there is shown a perspective view, partially in section, of one embodiment of burner assembly 10 of the present invention. Burner assembly 10 is comprised of a hollow, generally cylindrical shell 12 having a entry end 14 and a discharge end 16. Shell 12 is preferably comprised of a metallic material, such as stainless steel, as the shell 12 must be capable of withstanding high temperatures occurring during use of the burner. Engaged with the Shell 12 at the entry end 14 thereof is stem member 18. Stem member 18 is a hollow shaft utilized for supplying a combustible gaseous mixture to the entry end 14 of the shell 12. Stem 18 may be threadedly engaged with the entry end 14 of the shell 12. Illustrated in the preferred embodiment of FIG. 1, shell 12 contains a tapered end extension 19 extending beyond entry end 14 to allow threaded engagement with a threaded end portion of stem member 18. Discharge end 16 of shell structure 12 is swagged, allowing shell 12 to be of a decreasing diameter. Located at substantially the second end of stem member 18 is back piece 20. Back piece 20 contains at least one, and preferably a plurality, of orifices 22 for providing air to back piece 20, and one additional opening, preferably in a tapered form 24, with a precise orifice hole for providing an external source of a combustible gas to the back piece 20. Back piece 20 functions to mix the air and gas, thereby creating a combustible gaseous mixture which flows through stem member 18 and enters shell 12.

Fixedly mounted inside shell 12 is slug member 26. Slug member 26 has the form of a circular disk and corresponds in diameter to the inside diameter of the walls of shell 12 at the support sight. Slug member 26 contains a plurality of cavities 28 extending therethrough. Slug member 26 may be fixedly mounted inside shell 12 by any conventional means, however, in the preferred embodiment, once slug member 26 is positioned in the desired location along shell 12, shell 12 is crimped so as to fixedly position slug member 26 therewithin. Slug member 26 is preferably comprised of a metallic material, such as brass, as the slug member must be able to withstand the high temperatures of shell 12 ocurring during use of the burner, as well as being able to be conveniently machined or molded.

Slug member 26 is more fully illustrated in FIGS. 2, 3 and 3A. FIG. 2 illustrates a first face 26A of slug member 26; this first face of the slug member faces entry end 14 of shell structure 12. FIG. 3 illustrates a second face 26B of slug member 26; this second face of the slug member 26 faces discharge end 16 of shell structure 12. Cavities 28 extending through slug member 26 may be formed by molding of the cavities, or more conveniently, by boring the cavities therethrough.

Another feature of the present invention is that the construction of the slug provided more strength than a slug with vanes because the complete die contacts the inside diameter of the shell. This is helpful because better crimping can be used without damage to the slug. With better crimping when there is heating and cooling of the shell and slug, the slug will not fall out.

Another feature of the present invention is that the slug has more strength than a slug with vanes because the complete diameter contacts the ID of the shell. This is helpful because better crimping can be used without damage to the slug. With better crimping there is heating and cooling of shell and slug, slug will not fall out.

As the formation of the cavities through the slug members by a process of boring is preferred, the description of the construction of the slug will be described in light of such. It is to be noted, however, that other methods of constructing the slug member are also possible. Therefore, in referring now to FIG. 2, a central counter bore 27 is first drilled into slug member 26. The central bore extends only a portion of the way into slug member 26. The central bore is provided in the slug so that cavities 28 are shortened to an extent necessary to provide a straight through, line-of-sight, path way parallel to the central axis of the shell structure. Cavities 28 of slug member 26, however, extend through slug member 26 to the second face thereof, as illustrated in FIGS. 3 an 3A. Cavities 28, therefore, may be considered to form portions of the central bore. As shown in FIG. 3A, longitudinal axes 28A of the cavities 28 extend at angles relative to the longitudinal axis 12A of the shell structure 12, and of the longitudinal axis of the central bore. The angular relation between axes 28A and axis 12A will preferably fall within the range of 15 to 25 degrees at the same time the diameter of the cavities 28 is sufficiently large so that a sight path 28B extends through the cavities parallel to axis 12A particularly because the effect of counter bore 27. Each cavity emits a dispersion of two gaseous stream parts. As shown in FIG. 5, one stream part, indentified by reference numeral 29A, passes directly to a heat zone 29C. Another stream part, identified by reference numeral 29B, impinges because of the diverging path of travel on shell and rebound at an angle to join and co-mingle with other burning gases in the heat zone 29C. An even flame occurs in zone 29C which occupies an elongated and broad zone somewhat large e.g., 15%, in cross-section that the cross-section of discharge end 16.

As illustrated in the cut-away view of FIG. 4, slug member 26 is positioned in the shell 12 so as to substantially span a cross-section of the shell 12, and to cause the flow of the combustible gaseous mixture to be directed through the cavities 28 of slug member 26 as described above. The position of slug member 26 along the length of shell structure 12 is determined by the type of fuel used and the ratio of the fuel mixture. For fuels having a higher flash point, such as, for example, acetylene, the positioning of slug member 26 within shell 12 is closer to the entry end 14 of shell 12 than for fuels such as propane or butane.

In use, the burner assembly 10 of the present invention functions to produce a flame of a large area, and correspondingly large heat zone. As illustrated in FIG. 5, the paths taken by the combustible gaseous mixture as the mixture is directed through the cavities 28 of slug member 26 define the heat zone. As the pre-mixed combustible gaseous mixture is supplied to entry end 14 of shell 12 by stem member 18, the mixture is forced through cavities 28 of slug member 26. The construction and relationship of the cavities 28 in the slug member 26 divides the gaseous path along each cavity even though the cavity extends at angles relative to the longitudinal axis of shell 12 only part the mixture is caused to strike against the side walls of shell 12 at incident angles. The gaseous mixture is thereafter reflected from the walls whereat the mixture recombines and mixes with a second part of mixture emerging from the cavities 28 parallel to axis 12A. This flow of the gaseous mixture was found to significantly reduce the level of sound produced by the combination of high and low gas veolicities. The collision with the walls of shell 12 decreases the flow velocity of the combustible mixture so that upon reflection of the gaseous mixture and by further collisions of the various paths of the mixture during recombination of the various paths, the flow velocity is low enough so that the mixture may ignite. The discharge end 18 of shell 12 swagged only with acetylene allows eddying of the mixture to occur as the mixture is discharged from the shell 12. The flame caused by ignition of the mixture extends through the discharge end 16 of shell 12, and due to eddying of the mixture, flame 29C is produced. Because of the large flame area of flame 29C, a joint or brazing area may be evenly heated by the flame 34 to thereby prevent temperature gradients from having a deleterious effect on the braze area.

The burner assembly, shown in FIG. 6, essentially includes a burner tube 40 having a bent portion about mid-way along the length. A swagged flame discharge end 42 supports a slug member 44 which is constructed in the same manner as slug member 26 described hereinbefore. Tube 40 which is preferably made of stainless steel extends to a back piece 46 where the back piece is threadedly engaged with the tube 40 by way of a series of inner fitting threads the internal threads of which are formed in back piece 46. The threaded inner connection is formed between two members made of the same material e.g. brass namely, back piece 46 and sleeve 48. Sleeve 48 is secured to tube 40 by a solder connection. The back piece 46 is provided with openings 49 to allow the entrance of air into an internal pocket into the back piece. In the pocket there is an orifice plug by which combustible gas is discharged at a high velocity towards to the tube 40 thereby creating an influx of atmospheric air that mixes with a gas to provide a combustible gas mixture that flows through the tube 40 to the discharge end 42. As explained hereinbefore, the flame issuing from the discharge end defines a large flame area.

While the present invention has been described in connection with the preferred embodiment, it is to be understood that other similar embodiments may be used or modifications and additions may be made to the described embodiment for preforming the same functions of the present invention without deviating therefrom. Therefore, the present invention should not be limited to any single embodiment, but rather construed in breadth and scope in accordance with the recitation of the appended claims.

I claim as my invention:

1. A gas burner assembly, comprising:

an elongated, hollow housing having an entry and a discharge end separated by walls of the housing;

gas supply means attached to said housing for supplying a combustible gaseous mixture to said housing; and directing means positioned within said housing for directing a plurality of streams of the combustible gaseous mixture through said housing, said stream being divided by said directing means such that part of the combustible gaseous mixture is caused to strike and be reflected from the walls of the housing and another part of said mixture is caused to emerge from said housing unimpeded by contact with walls of the housing;

said directing means including a slug spanning the cross section of said housing, a central bore extending into the side of said slug facing said gas supply means, and a plurality of outwardly directed straight cavities in the slug extending from said central bore to the side of the slug from which the gaseous mixture emerges, said cavities serving to direct part of the gaseous mixture passing therethrough against the walls of the housing.

2. The gas burner assembly of claim 1 wherein said elongated hollow housing includes a hollow metallic shell.

3. The gas burner assembly according to claim 1 wherein said central bore supplies combustible gas to said straight cavities for subdividing of the combustible gas stream in each straight cavity.

4. The gas burner assembly of claim 1 wherein the longitudinal axes of said cavities extend at angles relative to the longitudinal axis of the housing.

5. The gas burner assembly of claim 1 wherein said housing comprises a cylindrical shell.

6. The gas burner assembly of claim 1 wherein said gas supply means for supplying the combustible gaseous mixture to said housing includes a stem member engaged with the entry end of said housing, wherein said stem member allows the flow therethrough of the combustible gaseous mixture.

7. The gas burner assembly of claim 6 further including a back piece connected to said stem member wherein said back piece contains at least one orifice opening thereinto for supplying air to the back piece, and at least one orifice opening thereinto for supplying a combustible gas to the back piece for mixing the air and the combustible gas theretogether.

8. The gas burner assembly of claim 7 wherein said orifice opening into the back piece for supplying combustible gas thereto includes a venturi.

9. A gas burner assembly, comprising:

a hollow shell having an entry end and a discharge end, wherein said entry end and said discharge end are separated by walls of the shell;

a stem member engaged with said entry end of the shell for providing to the shell a combustible gaseous mixture; and a slug member positioned in the shell and spanning a cross-section of said shell, a plurality of cavities of circular cross-section extending through said slug member to direct the combustible gaseous mixture therethrough, the longitudinal axes of every one of said circular cavities being at an angle to the longitudinal axis of said shell such that the cavities flare outwardly from their entrance ends which receive said gaseous mixture to their exit ends which face the discharge end of said hollow shell, the angles at which said cavities extend with respect to the axis of the shell and the cross sectional area of said cavities being such that part of the gaseous mixture passing therethrough will travel parallel to the axis of the shell and part will strike against the side walls of the shell, the two parts of the gas mixture from the cavities recombining in the shell to facilitate a large flame area of low noise level.

10. The gas burner assembly of claim 9 wherein said combustible gaseous mixture is supplied to the shell by the stem member at a velocity allowing said parts of the gaseous mixture to ignite only after the mixture is reflected from the walls of the shell.

11. The gas burner assembly of claim 9 wherein said slug member contains a central bore extending into one face thereof, and wherein said plurality of cavities extend from said central bore at their entrance ends to their exit ends at the other face of said slug member.

12. The gas burner assembly of claim 9 wherein the exit ends of said plurality of cavities do not extend to the outer periphery of said slug member whereby the outer periphery of the slug member is in snug uninterrupted contact with the inner periphery of said shell.

13. The gas burner assembly of claim 9 further including a back piece connected to said stem member wherein said back piece contains at least one orifice opening thereinto for supplying air to the back piece and an orifice extending thereinto for supplying a combustible gas to the back piece to thereby mix the air and the gas theretogether.

14. The gas burner assembly of claim 13 wherein said orifice opening into the back piece for supplying combustible gas thereto includes a venturi.

15. The gas burner assembly of claim 9 wherein said hollow shell comprises an elongated cylinder.

16. The gas burner assembly of claim 15 wherein said cylinder is of a decreasing diameter at the discharge end thereof.

* * * * *